US009172164B2

(12) United States Patent
Tang et al.

(10) Patent No.: US 9,172,164 B2
(45) Date of Patent: Oct. 27, 2015

(54) CARD EDGE CONNECTOR WITH AN IMPROVED HOUSING

(71) Applicant: HON HAI PRECISION INDUSTRY CO., LTD., New Taipei (TW)

(72) Inventors: Wen-Jun Tang, Kunshan (CN); Xue-Wu Bu, Kunshan (CN); Xian-Wei Feng, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/310,387

(22) Filed: Jun. 20, 2014

(65) Prior Publication Data

US 2014/0377972 A1 Dec. 25, 2014

(30) Foreign Application Priority Data

Jun. 20, 2013 (CN) ..... 2013 1 02439714
Jun. 20, 2013 (CN) ..... 2013 2 03524457 U

(51) Int. Cl.
*H01R 12/72* (2011.01)
*H01R 12/70* (2011.01)

(52) U.S. Cl.
CPC ..... *H01R 12/721* (2013.01); *H01R 12/7029* (2013.01)

(58) Field of Classification Search
USPC ..... 439/157.26, 267
See application file for complete search history.

(56) References Cited

U.S. PATENT DOCUMENTS

| | | | | |
|---|---|---|---|---|
| 3,160,455 | A * | 12/1964 | Mayon et al. | 439/60 |
| 4,095,866 | A * | 6/1978 | Merrill | 439/60 |
| 4,713,013 | A * | 12/1987 | Regnier et al. | 439/62 |
| 6,319,037 | B1 * | 11/2001 | Lai | 439/327 |
| 6,855,891 | B2 * | 2/2005 | Eguchi et al. | 174/250 |
| 7,442,063 | B2 * | 10/2008 | Sabo et al. | 439/267 |
| 7,922,506 | B1 * | 4/2011 | Harlan et al. | 439/160 |
| 8,444,424 | B2 * | 5/2013 | Shen et al. | 439/153 |
| 8,858,257 | B2 * | 10/2014 | Mo et al. | 439/578 |
| 8,900,001 | B2 * | 12/2014 | Li et al. | 439/157 |

FOREIGN PATENT DOCUMENTS

CN 202759077 2/2013

* cited by examiner

*Primary Examiner* — Alexander Gilman
(74) *Attorney, Agent, or Firm* — Wei Te Chung; Ming Chieh Chang

(57) ABSTRACT

A card edge connector which could be inserted by an electrical card with a pair of slopes in its bottom edge includes an insulating housing and a plurality of contacts retained in the insulating housing. The insulating housing includes a top surface, an elongated passageway which recesses from the top surface, and a pair of ladder sections or protruding portions which protrude into the passageway for supporting the slopes. Therefore, it can enhance the stability when the electrical card is inserted into the passageway.

17 Claims, 8 Drawing Sheets

CARD EDGE CONNECTOR WITH AN IMPROVED HOUSING

BACKGROUND OF THE INVENTION

1. Field of the Invention

The present invention relates to card edge connector, more particularly to a card edge connector with an improved housing.

2. Description of Related Art

China Patent No. 202759077, published on Feb. 27, 2013, discloses a related card edge connector for mating an electrical card, and the electrical card defines at least a notch and a recess. The card edge connector defines an elongated slot downwardly, and the slot defines a key corresponding to the notch. The bottom of the slot defines at least a convex corresponding to the recess and the convex locates at the end of the slot in the elongated direction. When the electrical card is inserted in the slot, the convex gets into the recess and supports the electrical card for preventing the electrical card from skewing.

However, it can not prevent the electrical card from drafting in the elongated direction, and a little draft would cause a poor contact or a dislocation between the contacts and the gold fingers, when the gold fingers are highly integrated.

Hence, an improved card edge connector is desired to overcome the above problems.

BRIEF SUMMARY OF THE INVENTION

An object of the present invention is to provide a card edge connector which could prevent the electrical card from drafting in the elongated direction.

In order to achieve the above-mentioned object, a card edge connector which could be inserted by an electrical card with a pair of slopes in its bottom edge includes an insulating housing and a plurality of contacts retained in the insulating housing. The insulating housing includes a top surface, an elongated passageway which recesses from the top surface, and a pair of ladder sections or protruding portions which protrude into the passageway for supporting the slopes. Therefore, it can enhance the stability when the electrical card is inserted into the passageway.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
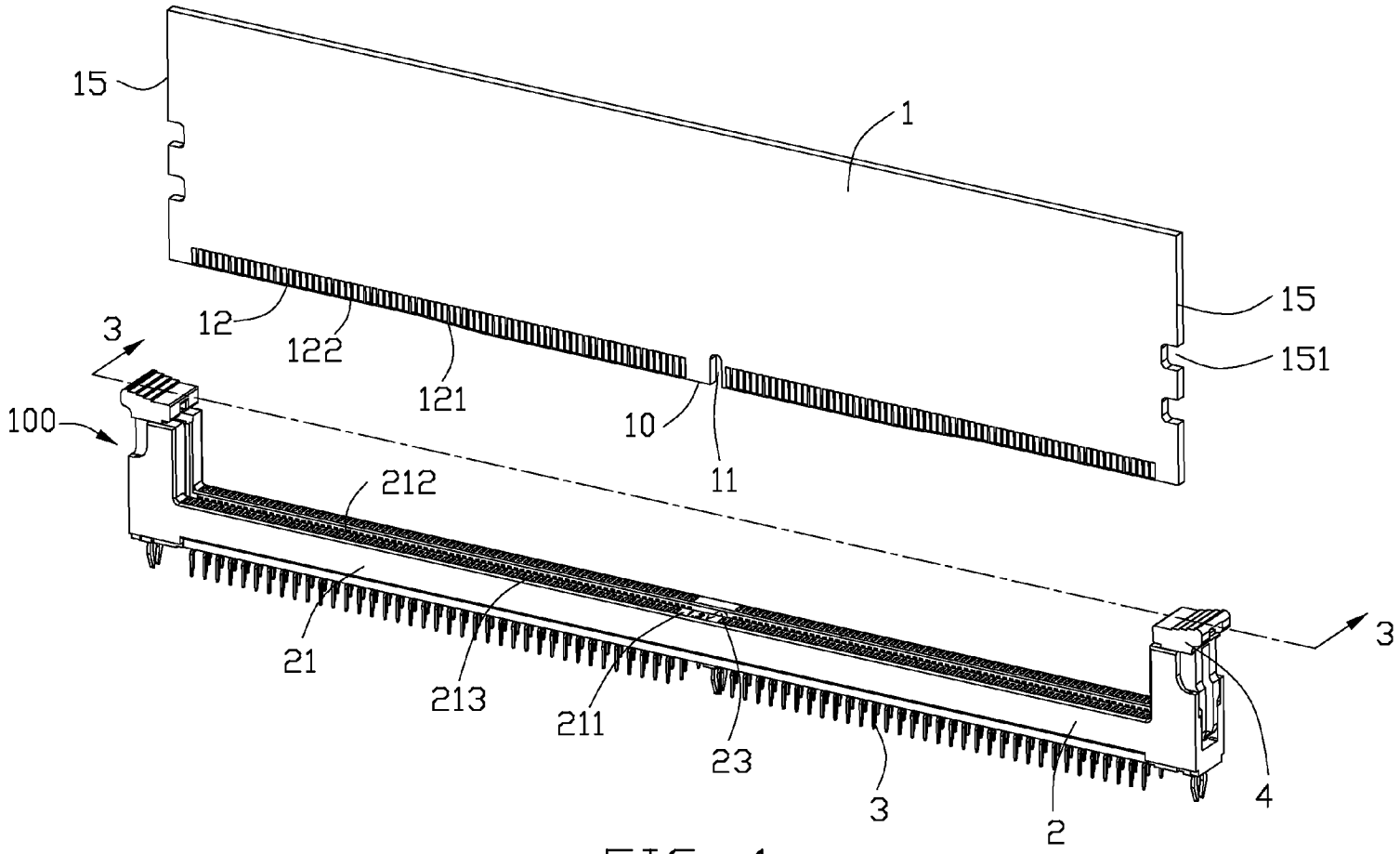
FIG. 1 is a perspective view of a card edge connector according to the present invention.

Reference will be made to the drawing figures to describe the present invention in detail, wherein depicted elements are not necessarily shown to scale and wherein like or similar elements are designated by same or similar reference numeral through the several views and same or similar terminology.

Referring to FIG. 1, according to the present invention, a card edge connector assembly comprises an electrical card 1 and a card edge connector 100. The electrical card 1 includes a bottom edge 10 and two side edges 15. The electrical card 1 defines at least a notch 11 and a pair of recesses 12, and each of the recesses 12 defines a flat portion 122 and a slope 121 connecting the flat portion 122 with the bottom edge 10.

Figure 2:
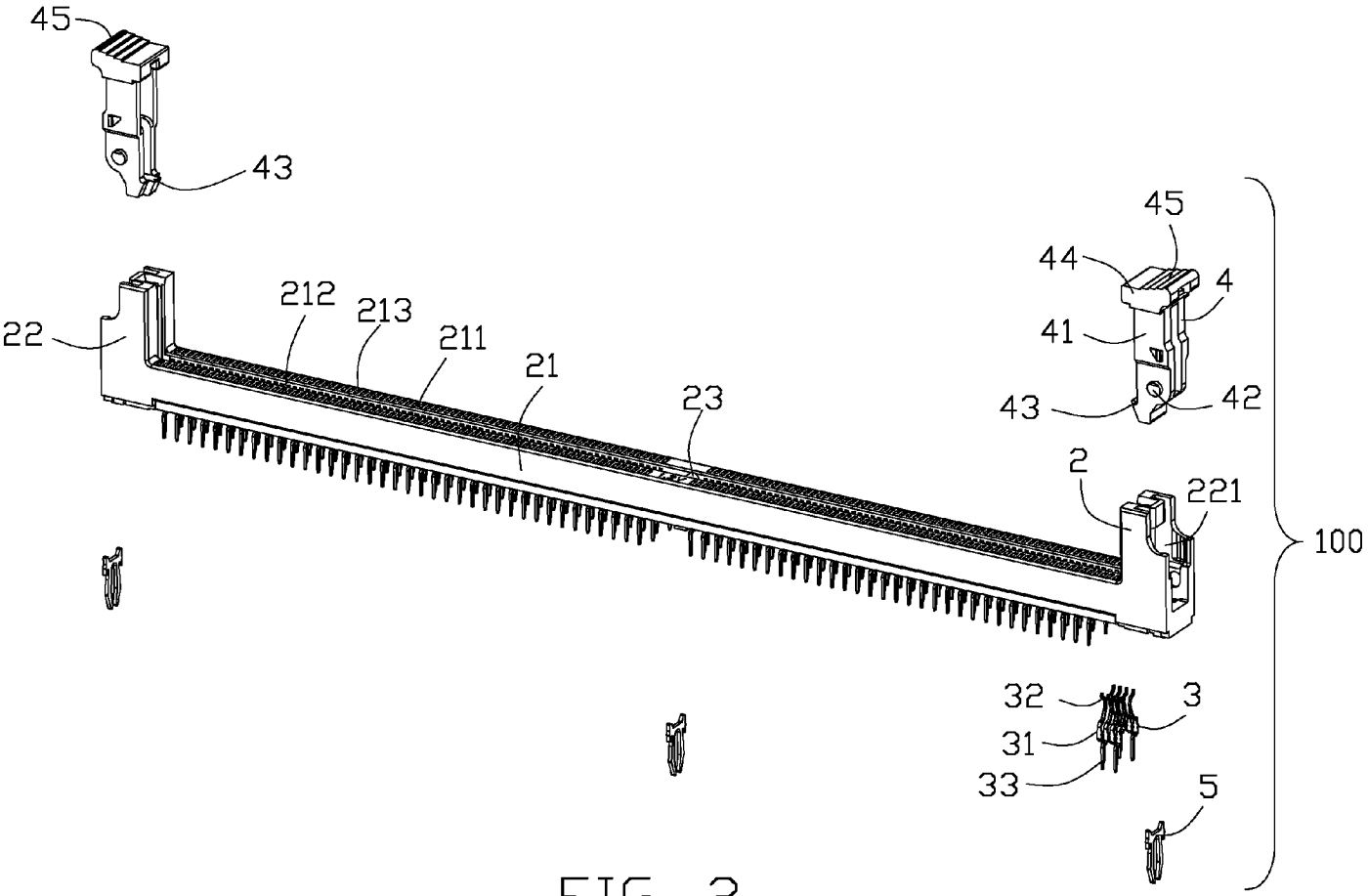
FIG. 2 is an exploded view of the card edge connector shown in FIG. 1.
Figure 3:
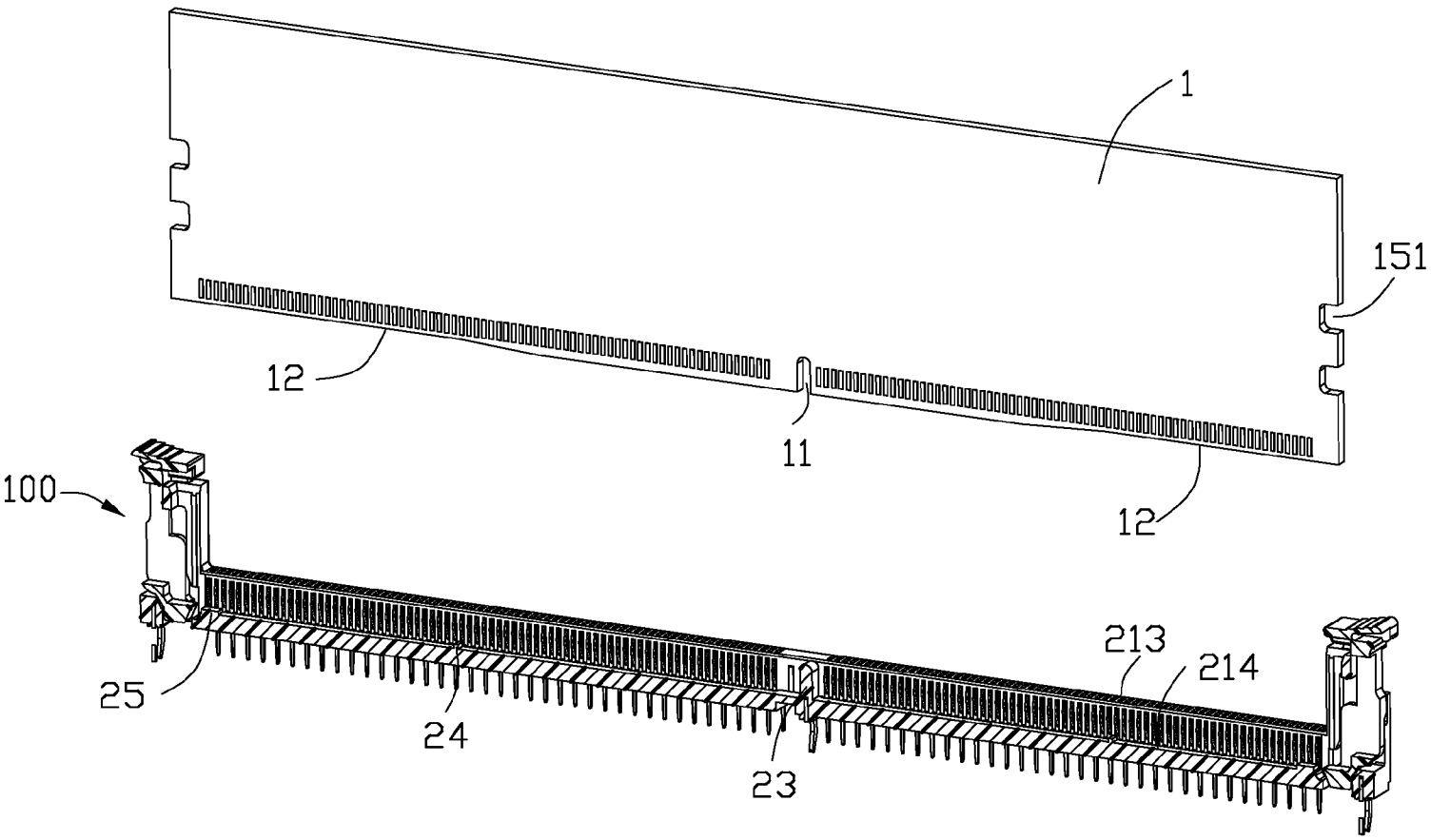
FIG. 3 is a cross section view of a card edge connector taken along a broken line 3-3 in FIG. 1 according to a first aspect of the present invention.

Referring to FIGS. 2-3, the card edge connector 100 comprises an insulative housing 2, a plurality of contacts 3 retained in the insulative housing 2, a pair of latches 4 disposed at both ends of the insulative housing 2 respectively along the elongated direction and at least two metal hooks 5 retained in a bottom of the insulative housing 2 for fixing the card edge connector 100.

The insulative housing 2 includes an elongated main body 21 and two tower portions 22. The main body 21 includes a top surface 211, an elongated passageway 212 which recesses from the top surface 211, two rows of slots 213 for receiving the contacts 3 in the two side walls of the passageway 212 and a key 23 protrudes from the bottom surface 214 of the passageway 212. The key 23 corresponds to the notch 11 of the electrical card 1 and deviates from one end of the passageway 212 in the elongated direction for preventing the electrical card from mismating.

Figure 4:
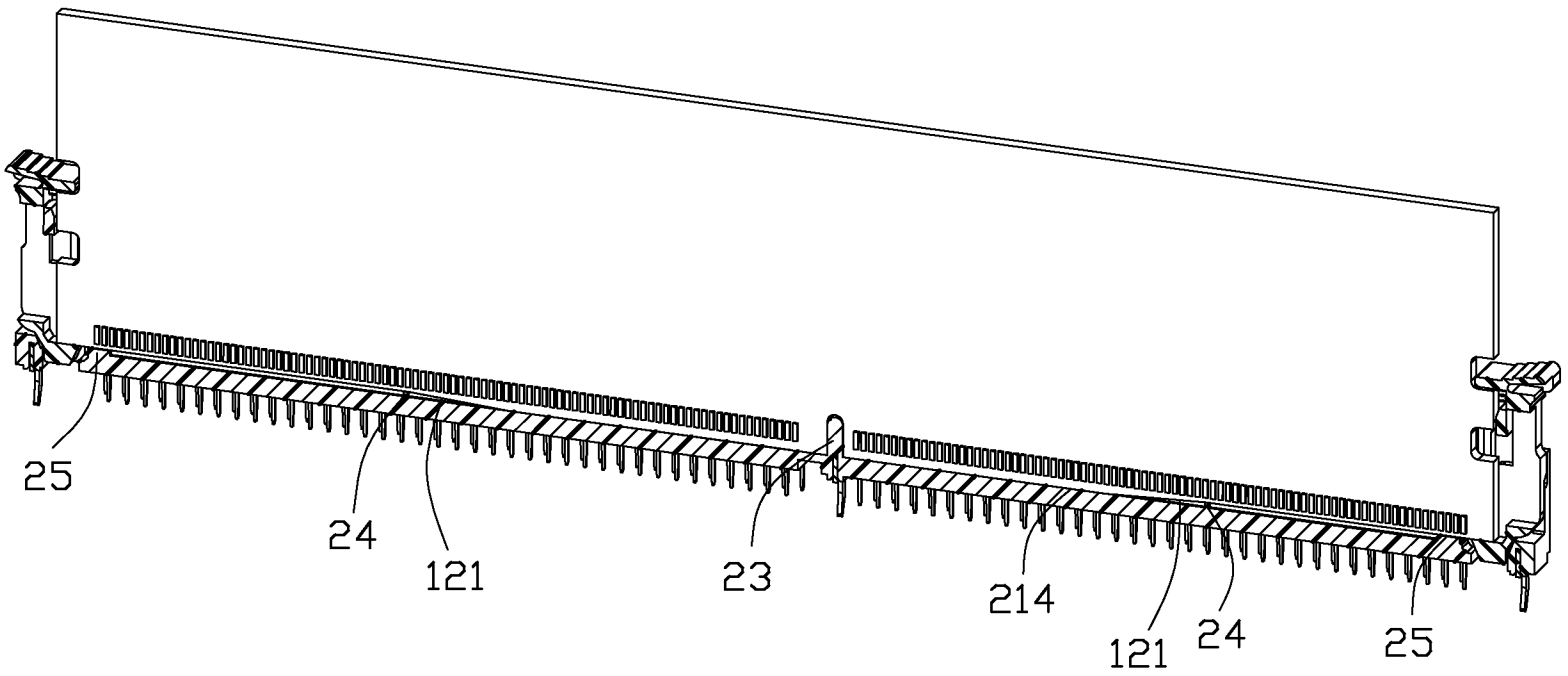
FIG. 4 is a perspective view of the card edge connector shown in FIG. 3 assembled with an electrical card.
Figure 5:
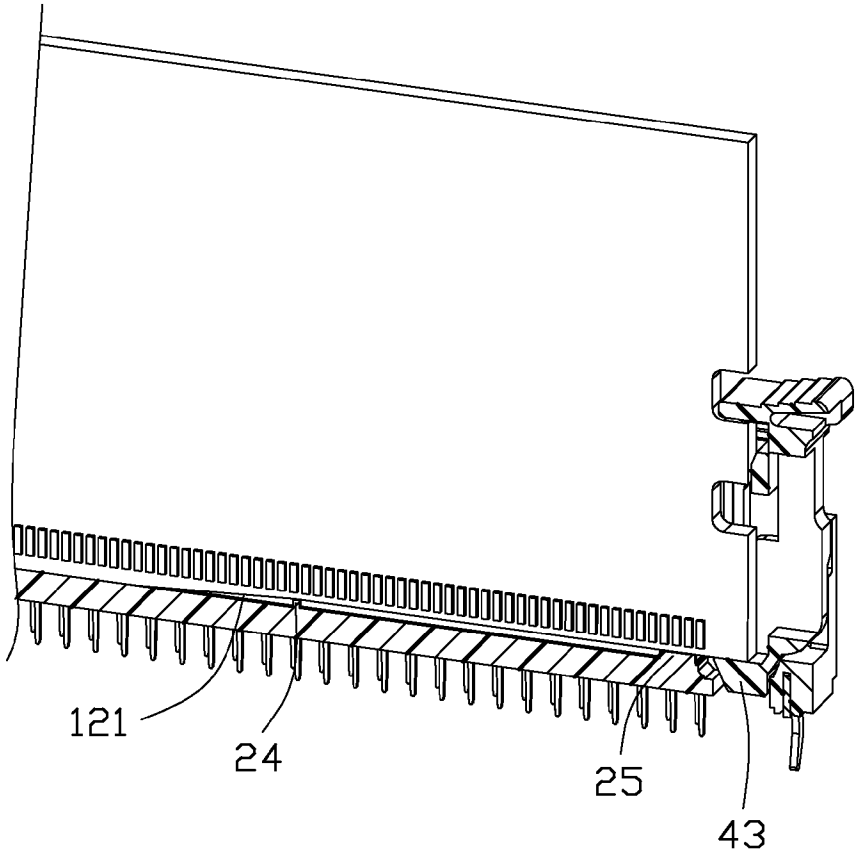
FIG. 5 is a partially view of the card edge connector assembly shown in FIG. 4.

Referring to FIGS. 4-5, the main body 21 defines a pair of protruding portions 24 protruding from the bottom surface 214 of the passageway 212 and located at two sides of the key 213. The protruding portion 24 is lower than the key 23. The protruding portions 24 correspond to the slopes 121, and the protruding portions 24 abut the slopes 121 for supporting and locating the electrical card 1 when the electrical card 1 is inserted into the card edge connector 100. And by which, it prevents the electrical card 1 from moving in the elongated direction.

According to the present aspect of the invention, the main body 21 also defines a pair of convex portions 25. The convex portion 25 protrudes from the bottom surface 214 of the passageway 212, and the convex portion 25 is higher than the protruding portion 24. The convex portion 25 could be as tall as the protruding portion 24 in other aspect of the invention (not shown). The width of the convex portion 25 and the protruding portion 24 could be same as the width of the passageway 212 or shorter than which in different aspects. The convex portion 25 corresponds to the recess 12 of the electrical card 1 for supporting the electrical card 1, and prevents the electrical card 1 from shake or vibration when it is inserted into the card edge connector 100.

Figure 6:
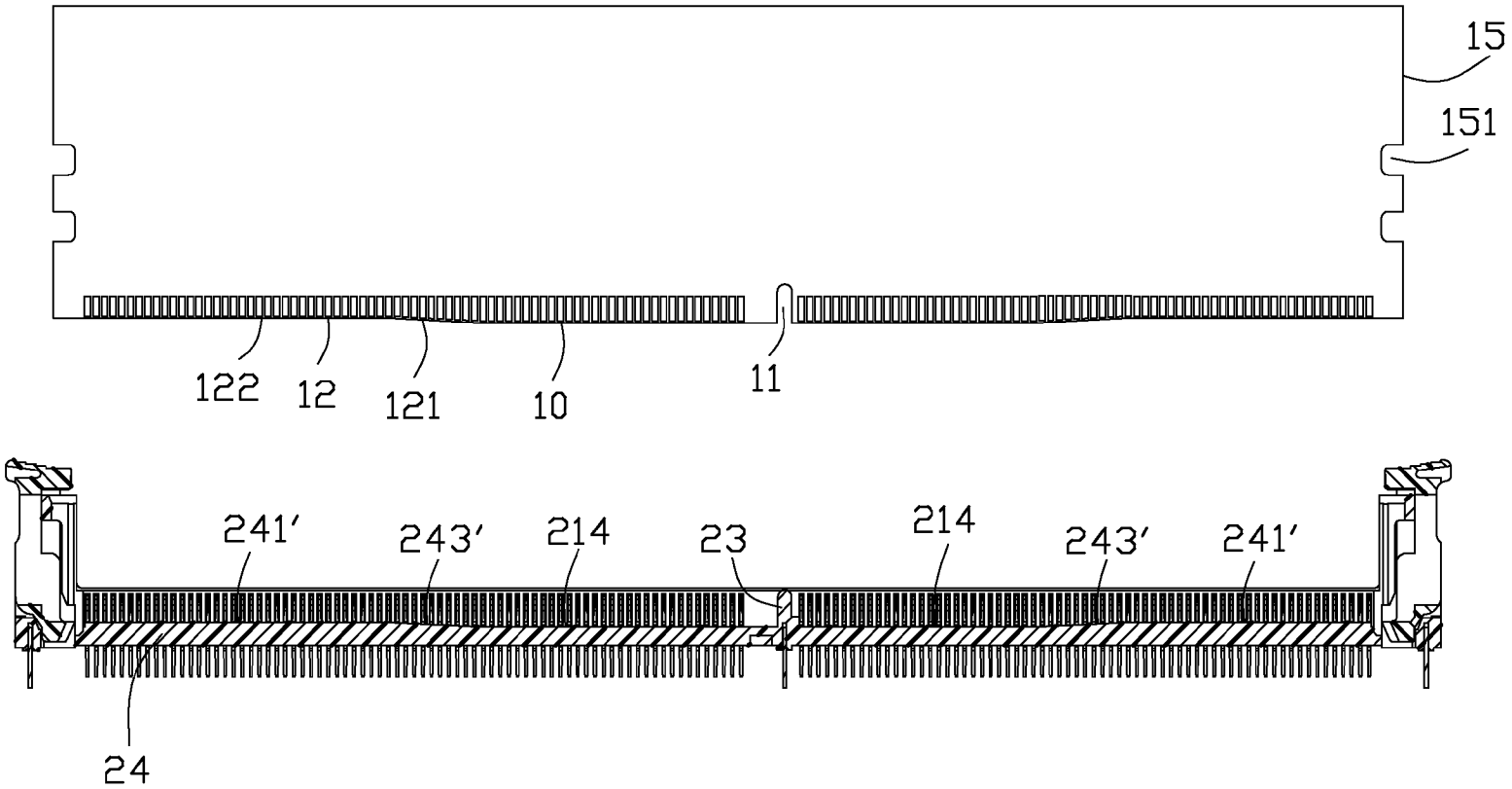
FIG. 6 is another aspect of the card edge connector assembly shown in FIG. 3.
Figure 7:
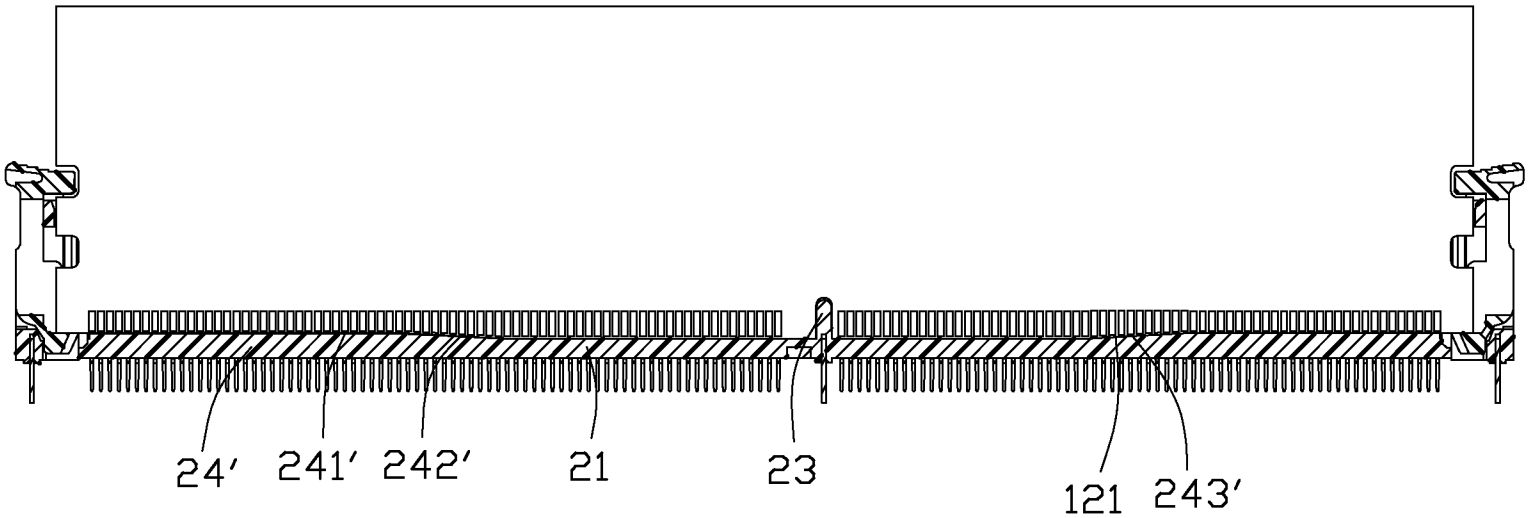
FIG. 7 is a perspective view of the card edge connector assembly shown in FIG. 6.
Figure 8:
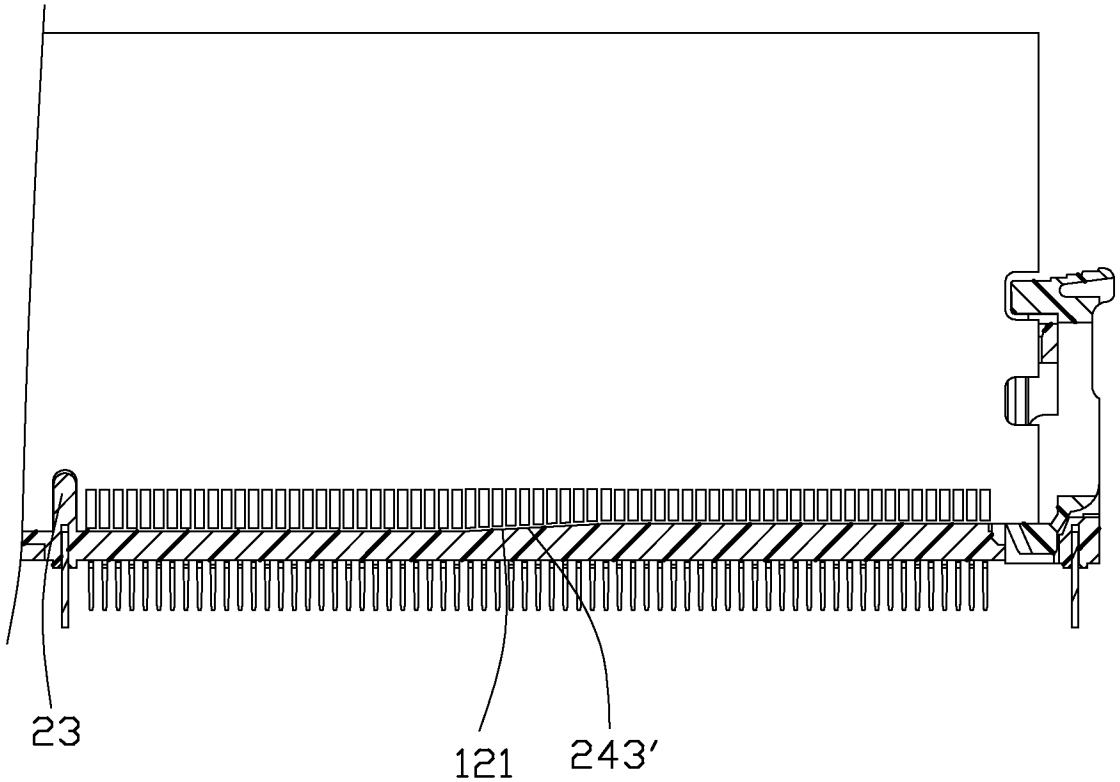
FIG. 8 is a partially view of the card edge connector assembly shown in FIG. 7.

Referring to FIGS. 6-8 and according to another aspect of the invention, the main body 21 defines a pair of ladder sections 24' protruding from the bottom surface 214 of the passageway 212 and located at two sides of the key 213. The ladder section 24' is lower than the key 23. The ladder section

24' includes a horizontal step surface 241' and an inclined portion 243' connects the horizontal step surface 241' with the bottom surface 214. The inclined portion 243' correspond to the slopes 121, and the inclined portions 243' abut the slopes 121 for supporting and locating the electrical card 1 when the electrical card 1 is inserted into the card edge connector 100. And by which, it prevents the electrical card 1 from moving in the elongated direction.

According to the present aspect of the invention, the length of the inclined portion 243' is as the same with the length of the slope 121 or longer than which in different aspects. The height of ladder section 24' is as the same with the height of the recess 12 or higher than which in different aspects. The length of horizontal step surface 241' in the elongated direction could be same as the length of the flat portion 122 or shorter than which in different aspects. The width of the ladder section 24' could be same as the width of the passageway 212 or shorter than which in different aspects in the transverse direction which is perpendicular to the elongated direction.

Referring to FIGS. 1-2, the tower portion 22 defines a groove 221, and the groove 221 is connected to the passageway 212. The groove 221 defines a shaft hole (not shown). The contacts 3 is arranged in two rows and retained in the slots 213. Each contact 3 has a retaining portion 31, an engaging section 32 extending upwardly from the retaining portion 31 and bending into the passageway 212, and a soldering tail 33 extending downwardly from the retaining portion 31. The engaging sections 32 is higher than the protruding portion 24 or the ladder section 24'.

The latch 4 is mounted into the groove 221 and includes a base portion 41, a pair of rotating shafts 42 protruding from two sides of the base portion 41 and pivoting in a pair of shaft hole formed by the tower portion 22, a pushing portion 43 extending towards the passageway 212 from one end of the base portion 41 in the opening station for pushing the memory card outwardly, an operating portion 45 disposed at distal end of the latch 4 and a locking portion 44 disposed at opposite end of the operating portion 45 and extending towards the passageway 212 from another end of the base portion 41 for locking the electrical card 1.

Referring to FIGS. 2-4, the key 23 gets into the notch 11 for preventing the electrical card 1 from mismating when the electrical card 1 is inserted into the card edge connector 100. In the process of a user inserts the electrical card 1 into the card edge connector 100, the bottom edge 10 of the electrical card 1 gets into the passageway 212 and contacts the engaging portion 32 firstly, and than the flat portion 122 of the recess 12 gets into the engaging portion 32 and the latch 4 rotates vertically that the locking portion 44 locking the gap 151 of the side edge 15 for locking the electrical card. At the moment, the protruding portion 24 and the convex portion 25 (or the ladder section 24') get into the recess 12 and support the electrical card from skewing. And what is more, the protruding portion 24 (or the ladder section 24') abuts the slope 121 of the electrical card 1 for fixing the position that the electrical card 1 locates when the electrical card 1 is inserted completely.

In the above process, the bottom edge 10 and the flat portion 122 insert into the passageway 212 successively, and it makes the clamp force the contacts bring to the electrical card 1 be in stages. And the insertion force is reduced therefore, and it makes the user convenient and easy to insert the electrical card 1 into the card edge connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector for mating with an electrical card, the electrical card including a bottom edge, a pair of recesses recessed upwardly from the bottom edge, and each of the recesses including a flat portion and a slope connecting the flat portion with the bottom edge, and the card edge connector comprising, an elongated insulative housing, extending in a longitudinal direction and defining a top surface, and an elongated passageway recessing downwardly from a top surface thereof;

and a plurality of contacts standing in two rows along two sides of the passageway and retained in the insulative housing, each of the contacts defining an engaging portion protruding into the passageway for an electrical contact with the electrical card;

wherein the insulative housing defines a pair of protruding portions protruding into the passageway and abutting the slope of the electrical card.

2. The card edge connector as described in claim 1, wherein the insulative housing defines a pair of convex portions protruding from a bottom surface of the passageway and corresponding to the flat portion, and the height of the convex portion is equal to or higher than the height of the protruding portion.

3. The card edge connector as described in claim 2, wherein the engaging portions are higher than the convex portions.

4. The card edge connector as described in claim 1, wherein the insulative housing defines a key protruding from the bottom surface of the passageway, and the protruding portion is lower than the key.

5. The card edge connector as described in claim 4, wherein the protruding portions locate at the two sides of the key in the longitudinal direction.

6. The card edge connector as described in claim 1, wherein the width of the protruding portion could be same as the width of the passageway or shorter than the width of the passageway.

7. A card edge connector for mating with an electrical card, the electrical card including a bottom edge, a pair of recesses recessed upwardly from the bottom edge, and each of the recesses including a flat portion and a slope connecting the flat portion with the bottom edge, and the card edge connector comprising, an elongated insulative housing, extending in a longitudinal direction and defining a top surface, and an elongated passageway recessing downwardly from a top surface thereof;

and a plurality of contacts standing in two rows along two sides of the passageway and retained in the insulative housing, each of the contacts defining an engaging portion protruding into the passageway for an electrical contact with the electrical card;

wherein the card edge connector defines a pair of ladder sections located at a bottom surface of the passageway, and each of the ladder sections defines an inclined portion for mating with the slope of the electrical card.

8. The card edge connector assembly as described in claim 7, wherein the ladder section includes a horizontal step surface, and the inclined portion connects the horizontal step surface with the bottom surface of the passageway.

9. The card edge connector assembly as described in claim 8, wherein the bottom edge of electrical card abuts the bottom surface of the passageway and the flat portion abuts the horizontal step surface of the ladder portion when the electrical card is totally inserted into the card edge connector.

10. The card edge connector assembly as described in claim 7, wherein the height of the ladder section is equal to or higher than the height of the recess.

11. The card edge connector assembly as described in claim 7, wherein the length of the inclined portion is as same as the length of the slope.

12. A card edge connector assembly comprising:

an elongated insulative housing defining a central slot extending along a horizontal longitudinal direction;

a plurality of contacts disposed in the housing by two sides of the central slot in a transverse direction perpendicular to said longitudinal direction;

a pair of ejectors located at two opposite ends of the housing in said longitudinal direction;

a memory module card having a bottom portion received in the central slot and opposite side portion locked by the ejectors, respectively;

a bottom edge of the memory module card forming a middle low horizontal section, a pair of outer high horizontal sections, and a pair of sloping sections linked between the low section and the corresponding outer high sections, respectively; and a bottom face of said central slot forming a middle low horizontal portion aligned with the middle low horizontal section in a vertical direction perpendicular to both said longitudinal direction and said transverse direction, and a pair of outer high horizontal portions aligned with the pair of high horizontal sections in the vertical direction, respectively; wherein each of said high horizontal portions defines at least two opposite supporting points respectively contacting two opposite ends of said corresponding high horizontal section in the vertical direction.

13. The card edge connector assembly as claimed in claim 12, wherein the high horizontal portion further defines a continuously extending horizontal coplanar line between said two opposite supporting points.

14. The card edge connector assembly as claimed in claim 13, wherein the high horizontal portions intimately contact the corresponding high horizontal sections in the vertical direction, respectively.

15. The card edge connector assembly as claimed in claim 12, wherein the bottom face of the central slot further forms a pair of sloping portions linked between the middle horizontal low horizontal portion and the corresponding outer high horizontal portions, respectively.

16. The card edge connector assembly as claimed in claim 15, wherein said sloping portions intimately contact the corresponding sloping sections in the vertical direction, respectively.

17. The card edge connector assembly as claimed in claim 12, wherein said low horizontal portion intimately contacts the low horizontal section in the vertical direction.

* * * * *